US011368796B2

(12) United States Patent
Piechowiak et al.

(10) Patent No.: US 11,368,796 B2
(45) Date of Patent: Jun. 21, 2022

(54) BINAURAL HEARING SYSTEM COMPRISING BILATERAL COMPRESSION

(71) Applicant: GN Hearing A/S, Ballerup (DK)

(72) Inventors: Tobias Piechowiak, Hedehusene (DK); Antonie Johannes Hendrikse, Ballerup (DK); Changxue Ma, Barrington, IL (US)

(73) Assignee: GN Hearing A/S, Ballerup (DK)

( * ) Notice: Subject to any disclaimer, the term of this patent is extended or adjusted under 35 U.S.C. 154(b) by 12 days.

(21) Appl. No.: 17/103,891

(22) Filed: Nov. 24, 2020

(65) Prior Publication Data

US 2022/0167097 A1 May 26, 2022

(51) Int. Cl.
*H04R 25/00* (2006.01)

(52) U.S. Cl.
CPC ..... *H04R 25/43* (2013.01); *H04R 25/505* (2013.01); *H04R 25/552* (2013.01); *H04R 2225/0216* (2019.05); *H04R 2225/55* (2013.01)

(58) Field of Classification Search
CPC . H04R 25/00; H04R 2225/49; H04R 2460/01
See application file for complete search history.

(56) References Cited

U.S. PATENT DOCUMENTS

| | | | | |
|---|---|---|---|---|
| 9,014,406 | B2 | 4/2015 | Thomsen et al. | |
| 10,469,962 | B2 | 11/2019 | Chen et al. | |
| 2010/0172506 | A1* | 7/2010 | Iwano | H04R 25/552 381/313 |
| 2011/0249823 | A1 | 10/2011 | Thomsen et al. | |
| 2013/0010972 | A1 | 1/2013 | Ma | |
| 2014/0185847 | A1 | 7/2014 | Gran et al. | |
| 2015/0319543 | A1 | 11/2015 | Xia et al. | |
| 2017/0180877 | A1 | 6/2017 | Hendrikse | |
| 2018/0091907 | A1 | 3/2018 | Long et al. | |
| 2019/0045308 | A1 | 2/2019 | Chen et al. | |
| 2021/0352421 | A1* | 11/2021 | Johannesson | H04R 25/43 |

FOREIGN PATENT DOCUMENTS

| | | |
|---|---|---|
| EP | 2544463 | 1/2013 |
| EP | 2696602 | 2/2014 |
| EP | 3185585 | 6/2017 |
| WO | WO 2018/038821 | 3/2018 |

OTHER PUBLICATIONS

Extended European Search Report for EP Patent Appln. No. 21155230.2 dated Jul. 13, 2021.
Technical Examination Report for Danish Patent Application No. PA 2021 70051 dated Aug. 18, 2021.

* cited by examiner

*Primary Examiner* — Suhan Ni
(74) *Attorney, Agent, or Firm* — Vista IP Law Group, LLP

(57) ABSTRACT

The present disclosure relates to a method of performing bilateral dynamic range compression of first and second microphone signals generated by first and second hearing aids, respectively, of a binaural hearing aid system. The method comprises to pick-up sound pressure inside an ear canal of the user's left or right ear by a first microphone to generate a first microphone signal in response to incoming sound and pick-up sound pressure inside an ear canal of the user's opposite ear by a second microphone to generate a second microphone signal in response to the incoming sound.

25 Claims, 4 Drawing Sheets

BINAURAL HEARING SYSTEM COMPRISING BILATERAL COMPRESSION

FIELD

The present disclosure relates to a method of performing bilateral dynamic range compression of first and second microphone signals generated by first and second hearing aids, respectively, of a binaural hearing aid system. The method comprises to pick-up or receive sound pressure inside an ear canal of the user's left or right ear by a first microphone to generate a first microphone signal in response to incoming sound and pick-up or receive sound pressure inside an ear canal of the user's opposite ear by a second microphone to generate a second microphone signal in response to the incoming sound.

BACKGROUND

Normal hearing individuals are capable of selectively paying attention to a desired sound source e.g. a target speaker to achieve speech intelligibility and to maintain situational awareness under noisy listening conditions such as restaurants, bars, concert venues etc. The latter are often designated cocktail party scenarios or sound environments. Normal hearing individuals are capable of utilizing a better-ear listening strategy where the individual focusses his or her attention on the speech signal of the ear with the best signal-to-noise ratio for the target talker or speaker. This better-ear listening strategy can also allow for monitoring off-axis unattended talkers by cognitive filtering mechanisms such as selective attention.

In contrast it remains a challenging task for hearing impaired individuals to listen to a particular, desired, sound source in such noisy sound environments. For hearing impaired individuals or patients that suffer from bilateral hearing loss, the use of a binaural hearing aid system offers a potential to restore the benefits of binaural hearing, including sound source localization and segregation. However, existing evidence suggests that patients or users with bilateral hearing loss access to binaural spatial cues or information, namely interaural time delays (ITDs) and interaural level differences (ILDs), can be distorted or compromised by signal processing in hearing aids of the binaural hearing aid system. Especially, non-linear gain-amplification, so-called dynamic range compression, that is applied unilaterally without coordination between the hearing aids has been shown to affect ILDs in a negative manner. This is a severe problem because the latter are important binaural spatial cues for localization at high frequencies such as above 1 kHz or above 1.5 kHz.

It has previously been attempted to mitigate this distortion of ILDs caused by unilaterally applied dynamic range compression in binaural hearing aid systems by the use of bilateral compression where the binaural hearing aid system seeks to coordinate or synchronize the dynamic range compression between the pair of hearing aids and thereby reestablish these ILDs in a timely manner.

However, in order to carry out this task the binaural hearing aid system needs a reference ILD to which to correct to for a given person, since ILDs varies significantly between individuals due to different head and ear shapes and dimensions etc. An accurate reference ILD is unfortunately not available with traditionally arranged hearing aid microphones, at or behind, the user's ear in the respective hearing aid housings. Sound pick-up at the latter positions fails to include acoustical contributions from the user's outer ear and concha. Stated in other words, the microphone signals picked-up by traditionally arranged microphones at or above the left and right ears do not accurately reflect the user's individual head related transfer functions, because they fail to include contributions by the user's outer ear and concha, and therefore do not include proper spatial cues, in particular ILDs.

Thus, there is a need in the art to accurately determine and exploit spatial cues in binaural hearing aid systems for example to accurately reestablish the user's or patient's individual ILDs despite ordinary dynamic range compression of the respective microphone signals from the left ear and right ear hearing aids. A microphone-in-the-ear form factor is uniquely built to achieve exactly that because the position for sound pick-up or receipt in the patient's ear-canal catches accurate HRTFs for left ear and right ear and the corresponding ILDs.

SUMMARY

A first aspect of the present disclosure relates to a method of performing bilateral dynamic range compression, such as bilateral wide dynamic range compression, or in brief compression, of first and second microphone signals generated by first and second hearing aids, respectively, of a binaural hearing aid system. The method comprising:

- picking-up sound pressure inside an ear canal of the user's first ear by a first microphone to generate a first microphone signal in response to incoming sound
- picking-up sound pressure inside an ear canal of the user's second ear by a second microphone to generate a second microphone signal in response to incoming sound,
- transmit second contralateral audio data representative of the second microphone signal to the first hearing aid via a wireless communication link,
- estimate, by a first digital processor at the first hearing aid, a first interaural level difference of the incoming sound based on respective levels of the first microphone signal and the second contralateral audio data,
- determine a first gain of the first microphone signal based on the level of the first microphone signal by a first dynamic range compressor in accordance with a first level-versus-gain characteristic,
- determine a second gain of the second microphone signal based on the level of the second microphone signal by a second dynamic range compressor in accordance with a second level-versus-gain characteristic,
- apply the second gain to the second microphone signal to generate a second output signal,
- adjust the first gain based on the first interaural level difference to preserve the first interaural level difference between first and second output signals,
- apply the adjusted first gain to the first microphone signal to generate the first output signal.

The first microphone signal may be generated by a first in-ear microphone comprised in the first hearing aid in response to the incoming sound. The second microphone signal may be generated by a second in-ear microphone comprised in the second hearing aid in response to the incoming sound.

The pick-up or receipt of the respective sound pressures inside the user's first and second ear canals, i.e. left ear canal and right ear canal or vice versa, by the first microphone and second microphone means that the first and second microphone signals comprise respective acoustic contributions from the user's outer ear and concha. The first and second microphone signals therefore provide an accurate representation of the user's individual left-ear head related transfer function and right-ear head related transfer function, i.e. accurate individual spatial cues such as Interaural cross ear differences including both interaural level differences (ILDs) and/or interaural time differences (ITDs) and/or interaural cross correlation coefficient.

The first hearing aid may comprise the first dynamic range compressor and the second hearing aid may comprise the second dynamic range compressor. The first dynamic range compressor may comprise a first multi-band compressor configured to apply respective compression ratios to a first plurality of frequency bands in accordance with a first plurality of level-versus-gain characteristics. The second dynamic range compressor may comprise a second multi-band compressor configured to apply respective compression ratios to a second plurality of frequency bands in accordance with a second plurality of level-versus-gain characteristics.

In some embodiments the present method of performing bilateral dynamic range compression may rely on a one-sided adjustment by merely adjusting the first gain to preserve the first interaural level difference between first and second output signals independent of the spatial location and therefore sound incidence angle of the target sound source or sources. Hence, according to the latter embodiment, merely the first gain is adjusted, typically reduced, by the first digital processor to compensate for distortion of the first ILD caused by the dynamic range compression effected by the first and second dynamic range compressors in typical listening environments or situations. In particular listening situations with off-center sound sources and where sound pressure levels of the incoming sound at the first and second microphones are sufficiently high to activate the first and second dynamic range compressors.

Certain embodiments of the present method of performing bilateral compression support a two-sided gain adjustment at the first and second hearing aids to preserve the first interaural level difference and/or a second interaural level difference between first and second output signals. The two-sided gain adjustment provides an advantageous flexibility by performing a desired gain adjustment in either the first hearing aid, by adjusting the first gain or in the second hearing aid, by adjusting the second gain. Finally, the desired gain adjustment can also be achieved by dividing the desired gain adjustment between the first hearing aid and the second hearing aid. Consequently, if a gain reduction of 10 dB is required in a particular sound environment to re-establish or preserve the estimated first interaural level difference between the first and second output signals, this may be achieved by reducing the first gain by 10 dB, or achieved by reducing the second gain by 10 dB, or be achieved by reducing the first gain by 8 dB and reducing the second gain by 2 dB etc. In these embodiments, the wireless communication link may be bidirectional and the first hearing aid is configured to transmit first contralateral audio data representative of the first microphone signal to the second hearing aid via the wireless communication link. The second digital processor of the second hearing aid utilizes the level of the second microphone signal and a level of the received first contralateral audio data to estimate or compute the second interaural level difference of the incoming sound. The skilled person will understand that the first and second interaural level differences may be substantially identical. These embodiments that support such two-sided gain adjustment further comprise:

adjust the second gain based on the second interaural level difference, apply the adjusted second gain to the second microphone signal to preserve, between first and second output signals, the second interaural level difference.

One embodiment of the present methodology which support the two-sided gain adjustment at the first and second hearing aids further comprises:

compare, by the first digital processor or by the second digital processor, the level of the first microphone signal to the level of the second microphone signal to determine which of the first and second hearing aids that is subjected to the lowest level of the incoming sound and reduce exclusively gain of the hearing aid subjected to the lowest sound level, to preserve the first or second interaural level difference between first and second output signals. Hence, if the incoming sound has the lowest level at the first hearing aid, more specifically at the first microphone, during a certain time period then the first gain is adjusted appropriately to preserve the first interaural level difference between first and second output signals while the second gain is left unadjusted. Likewise, if the incoming sound has the lowest level at the second hearing aid, more specifically at the second microphone, during another time period then the second gain is adjusted appropriately to preserve the second interaural level difference between first and second output signals while the first gain is left unadjusted. In this manner, the first and second gains are adjusted in an alternatingly manner over time because the particular hearing aid, of the binaural hearing aid system, which is subjected to the lowest sound level typically changes dynamically with relative positions and orientations of the user and environmental sound sources. This embodiment of the present methodology and binaural hearing aid system are advantageous because the gain of the hearing aid with the highest gain in given time period, or time instant, typically is reduced, as opposed to increased, to preserve the first or second interaural level difference. The gain reduction is typically required to compensate for the respective level compression actions on the first and second microphone signals imparted by the first and second dynamic range compressors. The selective reduction of the first gain and second gain, depending on the respective sound levels at the first and second hearing aids, reduces feedback stability problems because the gain of the hearing aid with the highest gain at a particular time instant is reduced.

Another embodiment of the present methodology which support the two-sided gain adjustment at the first and second hearing aids further comprises:

compare the level of the first microphone signal to the level of the second microphone signal to identify a hearing aid, of the first and second hearing aids, subjected to the lowest level of the incoming sound, reduce the gain of the hearing aid subjected to the lowest sound level and increase the gain of the hearing aid subjected to the highest sound level to preserve the determined interaural level difference between first and second output signals.

One embodiment of the present method of performing bilateral compression comprises a thresholding action to avoid gain adjustments when the first and/or second interaural level differences are small. This embodiment comprises:

adjust the first gain of the first microphone signal and/or adjust the second gain of the second microphone signal for first or second interaural level differences that exceed a threshold value such as 1 dB or 3 dB; and discard adjustment of the first gain and adjustment of the second gain for interaural level differences at and below the threshold value.

The first contralateral audio data and second contralateral audio data may represent the first and second microphone signals, respectively, in various formats for example by a native digital audio representation such as PCM at a particular sampling frequency and resolution e. g. PCM 16 bit @8-64 kHz. While the native digital audio representation is flexible it typical imposes a significant bandwidth requirement on the wireless communication link and accompanying high power consumption. Alternative formats of the first contralateral audio data and second contralateral audio data may be parametric or data compressed formats leading to reduced data throughput and bandwidth requirement of the wireless communication link. The parametric or compressed data formats of the first contralateral audio data and second contralateral audio data may comprise respective perceptually encoded signals to reduce data rates such as MP3, FLAC, AAC, Vorbis, MA4, Opus, G722. The parametric or compressed data formats may comprise respective power levels or energy levels of the first and second microphone signals for example respective power levels or energy levels of a plurality of individual frequency bands of each of first and second microphone signals as discussed in additional detail below with reference to the appended drawings.

One embodiment of the present methodology comprises splitting or dividing each of the first microphone signal and second microphone signal into a plurality of frequency bands by:

splitting the first microphone signal into a first plurality of frequency bands and determine respective signal levels thereof;

splitting the second microphone signal into a second plurality of frequency bands and determine respective signal levels thereof;

estimating, by the first digital processor at the first hearing aid, a first plurality of interaural level differences associated with the first and second plurality of frequency bands based on the respective levels of the first plurality of frequency bands and the second contralateral audio data, determining a first plurality of gain values for the first plurality of frequency bands, respectively, based on their respective levels in accordance with a first plurality of level-versus-gain characteristics, determining a second plurality of gain values for the second plurality of frequency bands, respectively, based on their respective levels in accordance with a second plurality of level-versus-gain characteristics, adjusting the first plurality of gain values based on respective ones of the first plurality of interaural level differences applying the first plurality of adjusted first gain values to respective ones of the first plurality of frequency bands of the first microphone signal to preserve, between the first and second output signals, the first plurality of interaural level differences; and/or applying the second plurality of adjusted second gain values to respective ones of the second plurality of frequency bands of the second microphone signal to preserve, between the first and second output signals, the first plurality of interaural level differences.

One embodiment of the present methodology utilizes a first additional microphone, i.e. in addition to the first microphone inside the user's left ear canal, and a second additional microphone, i.e. in addition to the second microphone inside the user's right ear canal as discussed in additional detail below with reference to the appended drawings. This embodiment preferably comprises:

picking-up sound pressure by an additional microphone of the first hearing aid arranged at, or behind, the user's first ear to generate a first additional microphone signal in response to incoming sound;

picking-up sound pressure by an additional microphone of the second hearing aid arranged at, or behind, the user's second ear to generate a second additional microphone signal in response to incoming sound;

mix the first additional microphone signal and the first microphone signal in a frequency dependent ratio to generate a first hybrid microphone signal, mix the second additional microphone signal and the second microphone signal in a frequency dependent ratio to generate a second hybrid microphone signal.

Another embodiment of the present methodology comprises feedback compensation by:

determining a transfer function of a first feedback path from the first output signal to the first microphone signal by the first digital processor; and:

compensating the first feedback path by a fixed or adaptive feedback cancellation filter to increase a maximum stable gain of the first hearing aid; and optionally estimating the maximum stable gain of the first hearing aid based on the transfer function of the first feedback path e.g. by the first digital processor; and mixing the first additional microphone signal and the first microphone signal such that the first additional microphone signal dominates the first hybrid microphone signal in a frequency range where the first gain exceeds the maximum stable gain of the first hearing aid. as discussed in additional detail below with reference to the appended drawings. The skilled person will understand that a corresponding feedback compensation may be carried out in the second hearing aid by the second digital processor.

The present method of performing bilateral dynamic range compression may further comprise:

detect speech segments and non-speech segments in the first microphone signal and the second microphone signal, adjust the first gain of the first microphone signal for the speech segments and/or adjust the second gain of the second microphone signal for the speech segments; and discard adjustment of the first and second gains for the non-speech segments. The skilled person will understand that the detection of speech segments may be carried out by suitably configured voice activity detector or detectors as discussed in additional detail below with reference to the appended drawings.

A second aspect of the present disclosure relates to a binaural hearing aid system comprising first and second hearing aids connectable through a wireless communication link. The first hearing aid is configured for placement at, or in, a user's left or right ear and comprises a first microphone arrangement and a first digital processor, wherein the first microphone arrangement comprises a first in-ear microphone arranged to pick-up or receive sound pressure inside the user's left or right ear canal. The second hearing aid is configured for placement at, or in, the user's opposite ear and comprises a second microphone arrangement and a second digital processor, wherein the second microphone arrangement comprises a second in-ear microphone arranged to pick-up or receive sound pressure in the user's opposite ear canal; and the first digital signal processor is configured to:

receive a first microphone signal generated by the first in-ear microphone in response to incoming sound, receive second contralateral audio data representative of the second microphone signal via the wireless communication link, estimate a first interaural level difference based on the first microphone signal and the second contralateral audio data, determine a first gain of the first microphone signal based on the level of the first microphone signal by a first dynamic range compressor in accordance with a first level-versus-gain characteristic, adjust the first gain and apply the adjusted first gain to the first microphone signal to generate a first output signal that preserve the first interaural level difference between the first output signal and second output signal generated by the second hearing aid.

The second digital signal processor is configured to:

receive a second microphone signal generated by the second in-ear microphone in response to incoming sound, generate and transmit the second contralateral audio data via the bidirectional wireless communication link, determine a second gain of the second microphone signal based on the level of the second microphone signal by a second dynamic range compressor in accordance with a second level-versus-gain characteristic, apply the second gain to the second microphone signal to generate the second output signal.

The first digital signal processor may further be configured to:

transmit first contralateral audio data representative of the first microphone signal to the second hearing aid via the wireless communication link; and the second digital processor is further configured to:

estimate a second interaural level difference of the incoming sound based on respective levels of the second microphone signal and the first contralateral audio data, adjust the second gain based on the second interaural level difference, apply the adjusted second gain to the second microphone signal to preserve, between first and second output signals, the second interaural level difference.

Each of the first and second hearing aids may comprise various housing styles or designs such as Microphone-and-Receiver-in ear (MaRIE) designs. The first hearing aid may comprise:

a first BTE housing configured for placement behind the user's left or right ear, a first ear plug configured for placement at least partly inside the user's left or right ear canal and comprising the first in-ear microphone arranged such that a first sound inlet of the first in-ear microphone is inside the user's ear canal. The second hearing aid in a corresponding manner comprises:

a second BTE housing configured for placement behind the user's opposite ear and a second ear plug configured for placement at least partly inside the user's other ear canal and comprising the second in-ear microphone arranged such that a second sound inlet of the second in-ear microphone is inside the user's ear canal.

According to one embodiment of the binaural hearing aid system each of the first and second ear plugs comprises both the in-ear microphone and a miniature speaker or receiver such that the first ear plug comprises:

an outwardly oriented surface comprising the first sound inlet of the first in-ear microphone, an inwardly oriented surface or portion comprising a sound outlet of a first miniature speaker or receiver configured to generate the first output signal as a first output sound pressure. The second ear plug comprises:

an outwardly oriented surface comprising the second sound inlet of the second in-ear microphone and an inwardly oriented surface or portion comprising a sound outlet of a second miniature speaker or receiver configured to generate the second output signal as a second output sound pressure.

The first BTE housing may comprise the previously discussed first additional microphone with associated sound inlet configured to generate the first additional microphone signal in response to the incoming sound. The second BTE housing may likewise comprise the previously discussed second additional microphone with an associated sound inlet configured to generate a second additional microphone signal in response to the incoming sound.

A method performed by a binaural hearing aid system having a first hearing aid and a second hearing aid, includes: generating a first microphone signal by a first microphone of the first hearing aid based on sound pressure inside a first ear canal of a first ear of a user; generating a second microphone signal by a second microphone of the second hearing aid based on sound pressure inside a second ear canal of a second ear of the user; transmitting contralateral audio data representative of the second microphone signal to the first hearing aid via a wireless communication link; estimating, by a first digital processor at the first hearing aid, a first interaural level difference based on the first microphone signal and the second contralateral audio data; determining a first gain for the first microphone signal based on a level of the first microphone signal in accordance with a first level-versus-gain characteristic; determining a second gain for the second microphone signal based on a level of the second microphone signal in accordance with a second level-versus-gain characteristic; adjusting the first gain based on the first interaural level difference; and applying the adjusted first gain to the first microphone signal to generate a first output signal.

Optionally, the method further includes: transmitting another contralateral audio data representative of the first microphone signal to the second hearing aid via the wireless communication link; estimating, by a second digital processor, a second interaural level difference based on the second microphone signal and the other contralateral audio data; adjusting the second gain based on the second interaural level difference; and applying the adjusted second gain to the second microphone signal.

Optionally, the adjusted second gain is applied to the second microphone signal to preserve the second interaural level difference.

Optionally, the method further includes: comparing, by the first digital processor or by the second digital processor, the first microphone signal and the second microphone signal to determine which of the first and second hearing aids is subjected to a lower level of incoming sound; and reducing a gain of one of the first hearing aid and the second hearing aid that is subjected to the lower level of incoming sound, to preserve the first or second interaural level difference.

Optionally, the method further includes: increasing a gain of the other one of the first hearing aid and the second hearing aid that is subjected to a higher level of the incoming sound, to preserve the first or second interaural level difference.

Optionally, the contralateral audio data representing the second microphone signal comprises a power level, an energy level, a native digital audio representation, or any combination of the foregoing, associated with the second microphone signal.

Optionally, the contralateral audio data comprises a perceptually encoded signal selected from the group consisting of MP3, FLAC, AAC, Vorbis, MA4, Opus, and G722.

Optionally, the method further includes: splitting the first microphone signal into a first plurality of first sub-signals in different frequency bands; and splitting the second microphone signal into a second plurality of second sub-signals in different frequency bands; wherein the act of estimating comprises estimating a first plurality of interaural level differences associated with the first plurality of first sub-signals and the second plurality of second sub-signals; wherein the act of determining the first gain comprises determining a first plurality of gain values for the first plurality of first sub-signals, respectively; wherein the act of determining the second gain comprises determining a second plurality of gain values for the second plurality of second sub-signals, respectively; wherein the act of adjusting the first gain comprises adjusting the first plurality of gain values based on respective ones of the first plurality of interaural level differences; and wherein the act of applying the adjusted first gain comprises applying the first plurality of adjusted gain values to respective ones of the first plurality of first sub-signals.

Optionally, the method further includes: generating a first additional microphone signal by a first additional microphone of the first hearing aid arranged at, or behind, the first ear; generating a first additional microphone signal by a second additional microphone of the second hearing aid arranged at, or behind, the second ear; mixing the first additional microphone signal and the first microphone signal to obtain a first hybrid microphone signal; and mixing the second additional microphone signal and the second microphone signal to obtain a second hybrid microphone signal.

Optionally, the method further includes: determining a transfer function of a first feedback path from the first output signal to the first microphone signal by the first digital processor; and compensating the first feedback path by a fixed or adaptive feedback cancellation filter to increase a maximum stable gain of the first hearing aid.

Optionally, the method further includes: generating a first additional microphone signal by an additional microphone of the first hearing aid arranged at, or behind, the first ear; and mixing the first additional microphone signal and the first microphone signal to obtain a hybrid microphone signal, wherein the mixing is performed such that the first additional microphone signal dominates in the hybrid microphone signal in a frequency range where the first gain exceeds a maximum stable gain of the first hearing aid.

Optionally, the first gain and/or the second gain is adjusted for interaural level differences exceeding a threshold value.

Optionally, the threshold value is 1 dB or higher.

Optionally, the first gain and/or the second gain is not adjusted for interaural level differences below the threshold value; or wherein an adjustment of the first gain and/or an adjustment of the second gain for interaural level differences below the threshold value is discarded.

Optionally, the method further includes detecting speech segment(s) and non-speech segment(s) in the first microphone signal and the second microphone signal; wherein the first gain and/or the second gain is adjusted for the speech segment(s).

Optionally, the first gain and/or the second gain is not adjusted for the non-speech segment(s); or wherein an adjustment of the first gain and/or an adjustment of the second gain for the non-speech segment(s) is discarded.

Optionally, the method further includes applying the second gain to the second microphone signal to generate a second output signal.

Optionally, the first interaural level difference is between the first and second microphone signals, and wherein the first gain is adjusted based on the first interaural level difference to preserve the first interaural level difference between first and second microphone signals.

A binaural hearing aid system includes: a first hearing aid configured for placement at, or in, a first ear of a user, the first hearing aid comprising a first microphone arrangement and a first digital processor, wherein the first microphone arrangement comprises a first in-ear microphone configured to pick-up sound pressure inside a first ear canal; and a second hearing aid configured for placement at, or in, a second ear of the user, the second hearing aid comprising a second microphone arrangement and a second digital processor, wherein the second microphone arrangement comprises a second in-ear microphone arranged to pick-up sound pressure in a second ear canal; wherein the first hearing aid and the second hearing aids are connectable through a wireless communication link; wherein the first digital signal processor is configured to: receive a first microphone signal generated by the first in-ear microphone, receive contralateral audio data representative of a second microphone signal transmitted from the second hearing aid to the first hearing aid via the wireless communication link, estimate a first interaural level difference based on the first microphone signal and the contralateral audio data, determine a first gain for the first microphone signal based on a level of the first microphone signal in accordance with a first level-versus-gain characteristic, adjust the first gain, and apply the adjusted first gain to the first microphone signal to generate a first output signal.

Optionally, the first output signal is configured to preserve the first interaural level difference.

Optionally, the second digital signal processor is configured to: determine a second gain for the second microphone signal based on a level of the second microphone signal in accordance with a second level-versus-gain characteristic, and apply the second gain to the second microphone signal to generate a second output signal.

Optionally, the first hearing aid is configured to transmit another contralateral audio data representative of the first microphone signal to the second hearing aid via the wireless communication link; and wherein the second digital processor is further configured to: estimate a second interaural level difference based on the second microphone signal and the other contralateral audio data, adjust the second gain based on the second interaural level difference, and apply the adjusted second gain to the second microphone signal.

Optionally, the first hearing aid comprises a first BTE housing configured for placement behind the first ear, and a first ear plug configured for placement at least partly inside the first ear canal, wherein the first ear plug comprises the first in-ear microphone; and wherein the second hearing aid comprises a second BTE housing configured for placement behind the second ear, and a second ear plug configured for placement at least partly inside the second ear canal, wherein the second ear plug comprises the second in-ear microphone.

Optionally, the first ear plug comprises an outwardly oriented surface comprising a first sound inlet for the first in-ear microphone, and a first inwardly oriented surface or portion comprising a first sound outlet for a first miniature speaker or receiver configured to provide the first output signal; and wherein the second ear plug comprises an outwardly oriented surface comprising a second sound inlet for the second in-ear microphone, and a second inwardly oriented surface or portion comprising a second sound outlet for a second miniature speaker or receiver configured to provide a second output signal.

Optionally, the first hearing aid comprises a first additional microphone in the first BTE housing configured to generate a first additional microphone signal; and wherein the second hearing aid comprises a second additional microphone in the second BTE housing configured to generate a second additional microphone signal.

The above and other features and embodiments will be described in the detailed description.

BRIEF DESCRIPTION OF THE DRAWINGS

In the following exemplary embodiments are described in more detail with reference to the appended drawings, wherein.

DETAILED DESCRIPTION OF EMBODIMENTS

Figure 1:
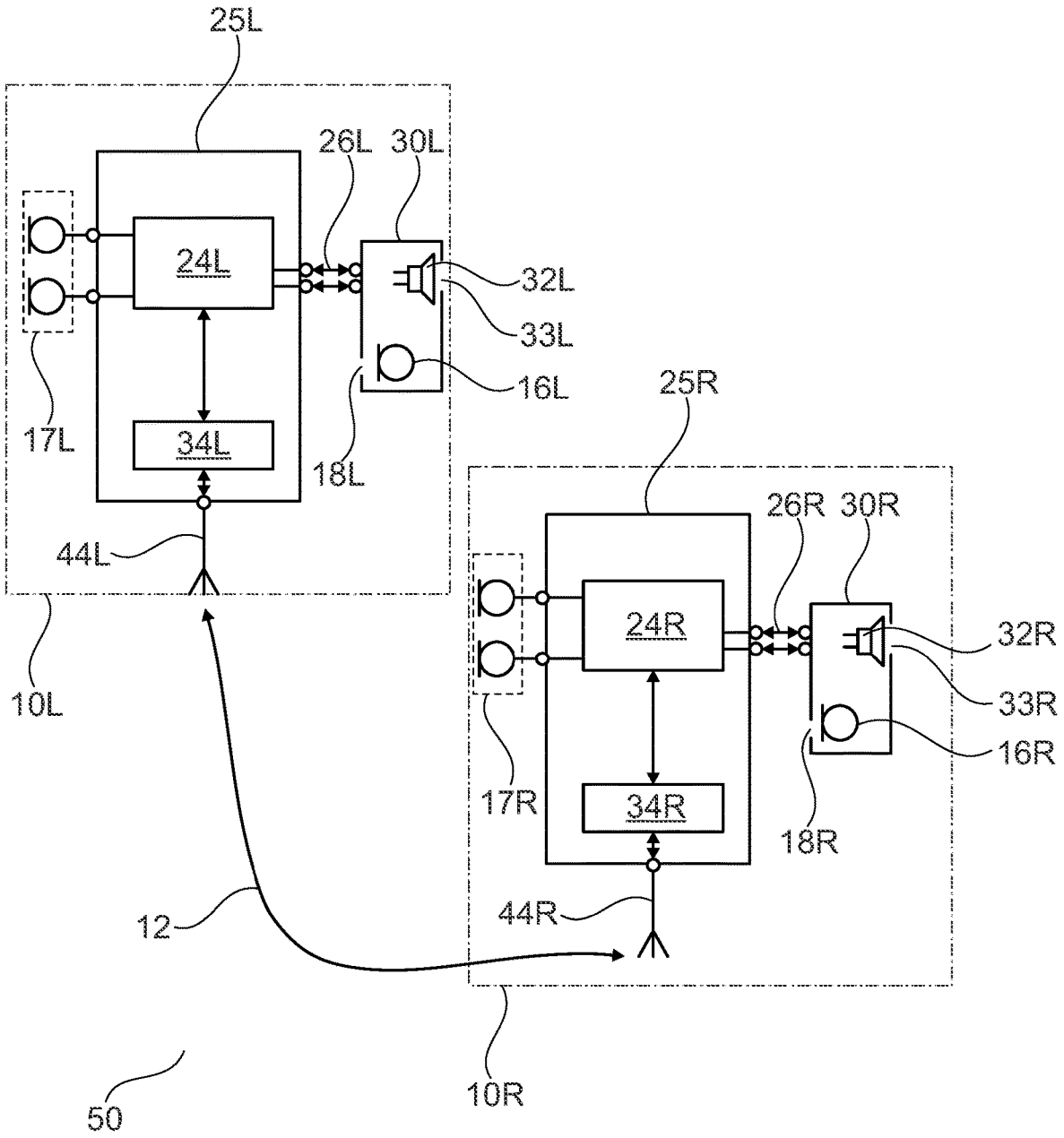
FIG. 1 schematically illustrates a binaural or bilateral hearing aid system comprising a left ear hearing aid and a right ear hearing aid connected via a wireless data communication link in accordance with some embodiments.

Various exemplary embodiments and details are described hereinafter, with reference to the figures when relevant. It should be noted that the figures may or may not be drawn to scale and that elements of similar structures or functions are represented by like reference numerals throughout the figures. It should also be noted that the figures are only intended to facilitate the description of the embodiments. They are not intended as an exhaustive description of the invention or as a limitation on the scope of the invention. In addition, an illustrated embodiment needs not have all the aspects or advantages shown. An aspect or an advantage described in conjunction with a particular embodiment is not necessarily limited to that embodiment and can be practiced in any other embodiments even if not so illustrated, or if not so explicitly described.

In the following various exemplary embodiments of the present binaural hearing aid system are described with reference to the appended drawings. The skilled person will understand that the accompanying drawings are schematic and simplified for clarity, and that they show details to facilitate understanding of the embodiments. Like reference numerals refer to like elements throughout. Like elements will, thus, not necessarily be described in detail with respect to each figure.

FIG. 1 schematically illustrates an exemplary binaural or bilateral hearing aid system 50 comprising a first or left ear hearing aid or instrument 10L and a second or right ear hearing aid or instrument 10R connectable through a wireless communication link 12, 34L, 44L, 34R, 44R that may be unidirectional link or bidirectional link. The left ear hearing aid 10L comprises a first wireless communication interface 34L coupled to a first digital processor 24L and to a first antenna 44L. The first antenna 44L may be a radio or magnetic induction antenna. The right ear hearing aid 10R likewise comprises a second wireless communication interface 34R coupled to a second digital processor 24R and to a second antenna 44R. The second antenna 44R may be a radio or magnetic induction antenna. The wireless communication link may possess sufficient bandwidth to support real-time streaming of digitized first and second microphone signals, or audio data representative thereof, to the other hearing aid. A unique ID may be associated with each of the left ear and right ear hearing aids 10L, 10R. The wireless communication interfaces 34L, 34R and antennas 44L, 44R of the binaural hearing aid system 50 may be configured to operate in the 2.4 GHz industrial scientific medical (ISM) band and may be compliant with a Bluetooth LE standard. Alternatively, each of the illustrated wireless communication interfaces 34L, 34R may comprise magnetic coil antennas 44L, 44R and be based on near-field magnetic coupling such as the NMFI operating in a frequency region between 10 and 50 MHz.

The left hearing aid 10L and the right hearing aid 10R may be substantially identical in some embodiments of the present hearing aid system expect for the above-described unique ID and possibly for the value of certain signal processing parameters as discussed in additional detail below. Therefore, the following description of the physical structures, features, components and signal processing functions of the left hearing aid 10L also applies to the right hearing aid 10R unless otherwise indicated. The left hearing aid 10L may comprise and be energized by a $ZnO_2$ battery (not shown) or a rechargeable battery that is connected for supplying power to a first hearing aid circuitry 25L. The first hearing aid circuitry 25L may at least comprise the first digital processor 24L and the first wireless data communication interface 34 L. Each of the left and right hearing aids 10L, 10R may be embodied in various housing styles or form factors for example as so-called such as Behind-the-Ear (BTE), In-the-Canal (ITC), Completely-in-Canal (CIC), Receiver-in-the Ear (RIE), Receiver-in-the Canal (RIC) or Microphone-and-Receiver-in ear (MaRIE) designs. The exemplary embodiment of the left hearing aid 10L is provided as a so-called MaRIE design and comprises a first BTE housing 210L configured for placement behind the user's left ear and a first ear plug 30L configured for placement at least partly inside the user's left ear canal as illustrated schematically on FIG. 2. The first ear plug 30L may comprise a customized housing, for example manufactured using impression taking or optical ear canal scanning and 3D manufacturing, fitting into the specific geometry of the user's ear canal. The first ear plug 30L may alternatively comprise a standardized housing for example using a compressible material, e.g. elastomeric agent or foam, to adjust to the specific geometry of the user's ear canal. The first ear plug 30L comprises a first in-ear microphone 16L and a first receiver or miniature speaker 32L as discussed in additional detail below. The second or right ear plug 30R may be formed in a similar manner to fit into the specific geometry of the user's right ear canal.

Returning to FIG. 1, certain embodiments of the left hearing aid 10L merely includes the first in-ear microphone 16L for pick-up or receipt of the incoming sound and subsequent processing. Alternative embodiments of the left hearing aid 10L comprises a distributed or hybrid microphone arrangement 16L, 17L including the first in-ear microphone 16L and a first additional microphone 17L as schematically illustrated. The hybrid microphone arrangement 16L, 17L may comprise a first pair of omnidirectional microphones 17L arranged in the first BTE housing, in addition to the first in-ear microphone 16L. Alternative embodiments of the hybrid microphone arrangement 16L, 17L merely comprise a single omnidirectional or directional microphone 17L in the first BTE housing.

The first pair of omnidirectional microphones 17L may generate a first additional microphone signal, such as a directional microphone signal, in response to the incoming or impinging sound. Respective sound inlets or ports (not shown) of the first pair of omnidirectional microphones 17L are preferably arranged with a certain spacing in the left or first BTE housing. The spacing between the sound inlets or ports depends on the dimensions and type of the housing but may lie between 5 and 30 mm. This port spacing range enables the formation of certain monaural beamforming signals. The first in-ear microphone 16L arranged in the left ear or first ear plug 30L is arranged to pick-up or receive sound pressure at an entrance to, or inside, the user's left ear canal via a first sound inlet 18L and generate a corresponding first microphone signal 60L. This may be achieved by arranging the first sound inlet 18L in an outwardly oriented surface of the housing of the first ear plug 30L where outwardly means projecting towards a concha/outer ear of the user's left ear, as opposed to inwardly towards an ear drum of the user's left ear canal. The first ear plug 30L additionally comprises the first miniature speaker or receiver 32L configured to generate a first or left ear output signal as a first or left ear output sound pressure via a first sound outlet 33L. The first sound outlet 33L may be arranged in an inwardly oriented surface or portion of the housing of the left ear plug 30L such that the left ear output sound pressure propagates to the user's left ear drum. The skilled person will appreciate that the housing of the left ear plug 30L preferably fits relatively tightly to the user's left ear canal, to acoustically isolate the first sound inlet 18L from the first sound outlet 33L of the first receiver 32L and suppress acoustic feedback there between to the extent possible as discussed in additional detail below.

The left hearing aid 10L may comprise one or more analogue-to-digital converters (not shown) which convert one or several analogue microphone signals generated by the hybrid microphone arrangement 16L, 17L into corresponding digital microphone signals with a certain resolution and sampling frequency such as between 8 kHz and 64 kHz for use by the first digital processor 24L.

The first BTE housing 210L and first ear plug 30L are preferably mechanically and electrically interconnected via a first bidirectional wired interface 26L as schematically illustrated on FIG. 1. The first bidirectional wired interface 26L may comprise one, two or more separate wires or conductors possibly protected by a surrounding compliant tubular member. The first bidirectional wired interface 26L may be a purely digital data interface carrying merely digital signals or a hybrid analog/digital interface. The first bidirectional wired interface 26L is configured to convey a first gain adjusted microphone signal generated and transmitted by the first digital processor 24L to the first receiver 32L which converts said first gain adjusted microphone signal into a corresponding sound signal, i.e. the left ear output sound pressure discussed above. The first bidirectional wired interface 26L is additionally configured to transmit a digitized or analog representation of the first microphone signal generated by the first in-ear microphone 16L to the first digital processor 24L for gain processing therein.

The skilled person will understand that each of the digital processors 24L, 24R may comprise a software programmable microprocessor such as a Digital Signal Processor or comprise hardwired digital logic circuitry. The operation of the each of the left and right ear hearing aids 10L, 10R may be controlled by a suitable operating system executed on the software programmable microprocessor 24L, 24R. The operating system may be configured to manage hearing aid hardware and software resources e.g. including execution of hearing loss compensation algorithms, control of the first wireless data communication interface 34L, estimation of first and second interaural level differences of the incoming sound, controlling the first and second dynamic range compressors and the first and second gain adjustments, managing certain memory resources etc. The operating system may schedule tasks for efficient use of the hearing aid resources and may further include accounting software for cost allocation, including power consumption, processor time, memory allocation, wireless transmissions, and other resources. The operating system may control operation of the wireless communication link 12, 34L, 44L, 34R, 44R. The right ear hearing aid 10R may have the corresponding hardware components and software components that function in a corresponding manner as mentioned above.

The first digital processor 24L is configured to perform single-channel or multichannel gain processing of the first microphone signal 60L as mentioned above. This gain processing is preferably carried out by the first dynamic range compressor in accordance with a first level-versus-gain characteristic thereof. The skilled person will understand that the first level-versus-gain characteristic of the first digital processor 24L may be set or defined at initial fitting of the left ear hearing aid 10L to the user or patient based on a certain fitting rule. This fitting rule such as NAL-1 defines a level dependent, i.e. non-linear, amplification of the first microphone signal 60L to compensate for the measured hearing loss of the patient. This fitting rule may be applied over a plurality of frequency bands or channels of the first dynamic range compressor to adapt the latter to compensate for frequency dependence of the patient's hearing loss. This fitting may be carried out by a dispenser using a fitting software platform coupled to the left and right ear hearing aids 10L, 10R via a suitable programming interface to program these with suitable fitting parameters, in particular first compressor parameters that defines the gain processing of the first dynamic range compressor and/or second compressor parameters that defines the gain processing of the second dynamic range compressor. These first and second compressor parameters may be written to, and stored in, respective non-volatile memories (not shown) of the left ear hearing aid 10L and right ear hearing aid 10R. The first digital processor 24L may be configured to read-out the compressor parameters from the non-volatile memory at boot-up of the first digital processor 24L and utilize these in the processing of the first microphone signal 60L by the first dynamic range compressor and the second digital processor 24R may perform corresponding actions at boot-up of the second digital processor 24R.

The first digital processor 24L is configured to generate and transmit first contralateral audio data 61L representative of the first microphone signal 60L via the bidirectional wireless communication link 12, 34L, 44L, 34R, 44R and to receive second contralateral audio data 61R (on FIG. 3) representative of the second microphone signal through the bidirectional wireless communication link 12, 34L, 44L, 34R, 44R. The second contralateral audio data 61L are preferably generated and transmitted by the second digital processor 24R in a corresponding manner to the generation of the first contralateral audio data 61L by the first digital processor 24L. The first digital processor 24L is configured to estimate a first interaural level difference between incoming sound at the user's left and right ears based on the first microphone signal 60L and the second contralateral audio data 61R as discussed in additional detail below. The second digital processor 24R may optionally be configured to estimate a second interaural level difference between incoming sound at the user's left and right ears based on the first microphone signal 60L and the second contralateral audio data 61R as discussed in additional detail below.

Figure 2:
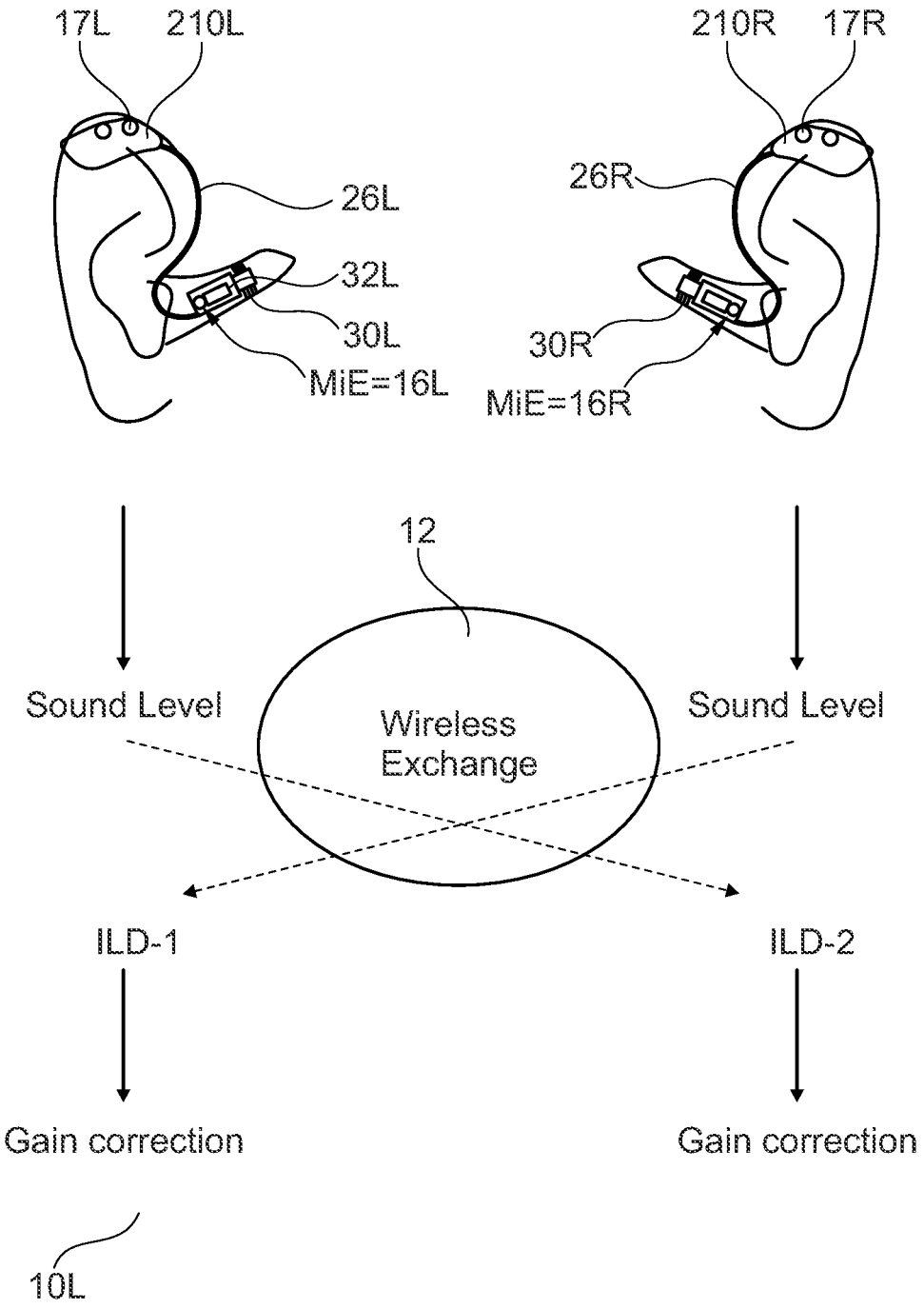
FIG. 2 is a schematic drawing of the arrangement of the binaural or bilateral hearing aid system mounted on a patient or user.

FIG. 2 is a schematic drawing of the arrangement of the binaural or bilateral hearing aid system (reference numeral 50 on FIG. 1) mounted behind and in the patient's left and right ears. The left ear hearing aid 10L comprises the first BTE housing 210L arranged behind the user's left ear lobe and the first ear plug 30L is arranged fully inside the user's left ear canal as illustrated schematically. The first or left ear BTE housing 210L and first ear plug 30L are mechanically and electrically interconnected via the previously discussed first bidirectional wired interface 26L. The right ear hearing aid (reference numeral 10R on FIG. 1) likewise comprises the second BTE housing 210R arranged behind the user's right ear lobe and the second ear plug 30R is arranged fully inside the user's right ear canal as illustrated schematically. The right ear BTE housing 210R and second ear plug 30R are mechanically and electrically interconnected via the previously discussed second bidirectional wired interface 26R.

The skilled person will understand that the sound pressure pick-up or receipt position of the first in-ear microphone 16L inside the user's left ear canal means that the first microphone signal 60L comprises sound contributions from the user's outer ear and concha and therefore provides an accurate representation of the user's individual left-ear head related transfer function, i.e. proper spatial cues. The same is true for the user's individual right-ear head related transfer function as measured by the corresponding second in-ear microphone 16R inside the user's right ear canal such that individual ILDs, as well as other spatial cues, between the user's left and right ears can be accurately determined.

Figure 3:
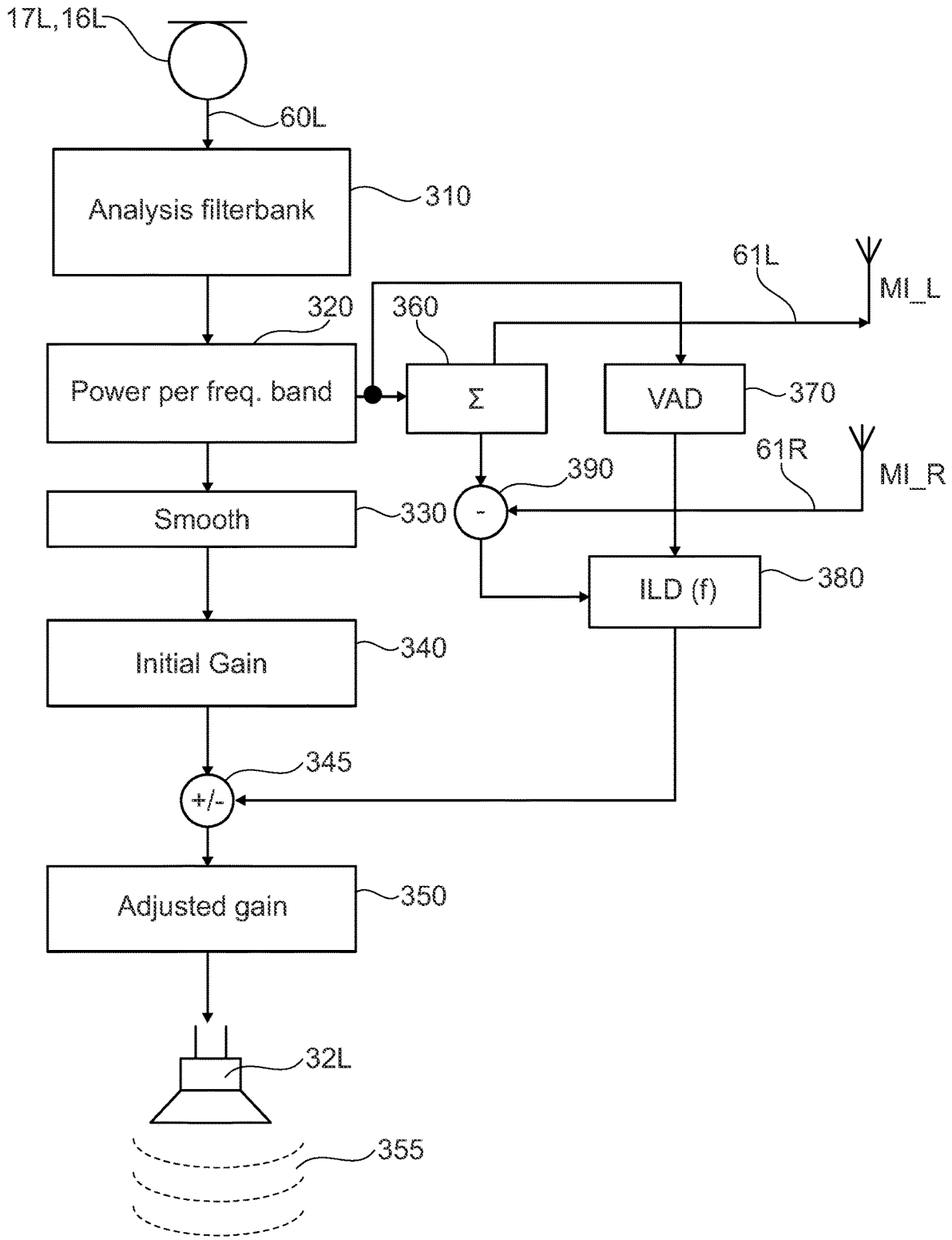
FIG. 3 shows a flow chart of for signal processing operations and functions carried out signal processors of left ear and right ear hearing aids in accordance with some embodiments.

FIG. 3 shows a chart of signal processing steps and signal processing functions or circuits that may be comprised in the present exemplary method of performing bilateral dynamic range compression as carried out by the first digital processor 24L of the first hearing aid 10L of the exemplary binaural hearing aid system 50, shown in FIG. 1. The skilled person will appreciate that the second digital processor 24R of right ear hearing aid 10R may carry out corresponding signal processing steps. The first in-ear microphone 16L arranged in the first ear plug 30L (shown in FIGS. 1 and 2) produces a first electrical microphone signal, e.g. represented in the digital domain or format, in response to the incoming sound as described above. The first microphone signal 60L is preferably applied to an input of an analysis filter bank 310 which is configured to split or divide the first microphone signal 60L into a first plurality of overlapping or non-overlapping frequency bands. The first plurality of overlapping or non-overlapping frequency bands may comprise between 4 and 128 individual frequency bands such as between 8 and 32 bands. The analysis filter bank 310 may operate in the frequency domain, e.g. using Fast Fourier Transform techniques, or operate in the time domain and for example comprise a so-called WARP filter providing the first plurality of frequency bands on a perceptually relevant scale, e.g. comprising 17 individual frequency bands. The skilled person will understand that alternative embodiments of the present method of performing bilateral dynamic range compression may skip the analysis filter bank 310 and process the entire bandwidth, e.g. 100 Hz-8 kHz, of the first microphone signal 60L as a single frequency band.

Respective signal levels, for example represented by respective energy or power levels, of the first plurality of frequency bands of the first microphone signal 60L are determined by the first digital processor in step 320. The respective signal levels of the first plurality of frequency bands are smoothed by the first signal processor in step 360 using individual attack times and individual release times for the frequency bands. The both the attack times and release times may lie between 0.5 ms and 100 ms where the shortest attack/release time constants are utilized in the higher frequency bands, e.g. above 3 kHz, and longest release time constants are utilized in the lower frequency bands e.g. below 200 Hz. The respective smoothed signal level estimates of the first plurality of frequency bands of the first microphone signal 60L are applied by the first digital processor (not shown) to the previously discussed bidirectional wireless communication link, schematically represented by antenna symbol MI_L, and transmitted there through to the right ear hearing aid. The respective smoothed signal level estimates of the first plurality of frequency bands are received at the right ear hearing aid where they may be seen as first contralateral audio data 61L representative of the first microphone signal 60L. The first contralateral audio data are preferably updated at regular time intervals and thereafter transmitted through the wireless communication link for example using a packet-oriented communication protocol. An update frequency of the first contralateral audio data 61L may lie between 10 Hz and 350 Hz for data rates between 2.6 kbps and 266 kbps dependent on the nature of the wireless communication link and its communication protocol. Care must be taken to choose the update frequency so as to avoid too long delay times to ensure the first contralateral audio data 61L, at receipt at the second hearing aid, are truly representative of the first microphone signal 60L at the current time instant and not too "old". This challenge may be addressed by computing the first ILD and/or second ILD on two different time scales. The first time scale may be fixed by the communication or transmission protocol on the wireless communication link. The second time scale may be fixed by the above-mentioned sampling frequency of the first microphone signal. Thus, the first and second gains can be applied closer to the most recently computed ILDs.

The second digital processor of the right ear hearing aid (shown in FIG. 1) may determine in a similar manner respective smoothed signal level estimates of a second plurality of frequency bands of the second microphone signal 60R and transmits those estimates as second contralateral audio data 61R to the left ear hearing aid through the bidirectional wireless communication link, schematically represented by antenna symbol MI_R. In step 390 the smoothed signal level estimates of the second plurality of frequency bands are subtracted from the correspondingly smoothed signal level estimates of the first plurality of frequency bands such that a first plurality of interaural level differences (ILDs) between the first and second microphone signals 60L, 60R per frequency band is determined in step 380. The determined first interaural level differences are applied to gain adjustment processing 345 which adjust initially determined gain values for the first plurality of frequency bands as earlier determined in step 340. To determine these initial plurality of first gain values, the first signal processor uses the previously determined or computed smoothed signal levels of the first plurality of frequency bands.

In step 330 the respective signal levels of the first plurality of frequency bands are preferably smoothed by integration with respective time constants such as individual attack times and release times. The attack times may lie between 12 ms and 50 ms while the release times may lie between 125 ms and 6000 ms where shorter attack times are utilized in the higher frequency bands, e.g. above 3 kHz, and longer release time constants are utilized in the lower frequency bands e.g. below 200 Hz.

In step 340 the first signal processor is configured to determine an instantaneous gain value of the dynamic range compressor or compression algorithm of that frequency band by reference to its level-versus-gain characteristic and reference to the smoothed signal level of that frequency band as outputted by the multiband smoothing operation 330. The skilled person will understand that the respective level-versus-gain characteristics of the first plurality of frequency bands may be defined by one or more look-up tables mapping sound pressure levels of the incoming sound to corresponding gains of the first dynamic range compressor within the first plurality of frequency bands. The level-versus-gain characteristic of a particular frequency band may comprise a lower compression knee point e.g. an in-band signal level corresponding to between 40 and 55 dB SPL, and/or an upper compression knee point e.g. the in-band signal level corresponding to between 90 and 100 dB SPL. Below the lower knee point, the level-versus-gain characteristic of the dynamic range compressor may define essentially linear amplification and above the upper knee point, the level-versus-gain characteristic may define essentially infinite compression ratio such as above 10:1. For signal levels in-between the lower and upper knee points which signal levels correspond to the majority of normal sound levels for everyday communication, the level-versus-gain characteristic of a particular frequency band may define a constant or level variable compression ratio between 1.2 and 3.0. The latter compression ratio interval is well-suited to compensate for recruitment of the user's hearing loss and restore normal loudness perception of desired sounds like speech. By using individually computed level-versus-gain characteristics of the dynamic range compressor of each frequency band, an accurate loudness compensation of the user's hearing loss can be provided even if the user's hearing loss exhibits a pronounced frequency dependency. The skilled person will appreciate that the respective level-versus-gain characteristics of the first plurality of dynamic range compressors, and of the corresponding second plurality of dynamic range compressors of the right ear hearing aid, may be determined at the initial fitting of the binaural hearing aid system at the dispenser's office. The respective level-versus-gain characteristics of the first plurality of frequency bands are therefore used by the first digital processor to determine respective ones of the initial gain values in step 340.

The plurality of initial first gain values are applied to the adjustment processing 345 to determine a corresponding plurality of adjusted first gain values to be used by step 350. The plurality of adjusted first gain values are applied to the plurality of frequency bands of the first microphone signal 60L in step 350 and the amplified first microphone signal is applied to the first receiver 32L for example through a suitable synthesis filter (not shown) and suitable output/power amplifier. The power amplifier may comprise a class-D amplifier to drive the first miniature loudspeaker with high efficiency and sufficient power and deliver a corresponding acoustic output signal or sound pressure 355. The first gain value within each frequency band may be increased or decreased or left unchanged by the gain adjustment processing 345 depending on the ILD at that frequency band as determined by step 380 and also depending on the corresponding, or second, ILD for the same frequency band which may be determined in parallel by the second digital processor of the second hearing aid. However, in all instances the goal of the gain adjustment(s) of each frequency band is to preserve in that frequency band, between first acoustic output signal 355 and corresponding second acoustic output signal, the first interaural level difference (ILD) for that band as determined by ILD step 380. In other words, the ILD between the first and second microphone signals per frequency band is preserved by the output sound signals supplied to the user's left and right ears. As a simple example suppose that the ILD between the first and second microphone signals in a particular frequency band or bands at a particular time instant is measured or determined in step 380 to be 20 dB. If the respective compression ratios of the first and second dynamic range compressors of the left ear and right ear hearing aids are set to e.g. 2:1 at hearing aid fitting, this means that the ILD between the first and second acoustic output signals is reduced to about 10 dB in that frequency band due to dynamic range compressor actions. Hence, the aim of the combined gain adjustment in steps 345 of the first and second hearing aids is to re-establish the ILD of 20 dB.

This re-establishment of ILD may be carried out in several ways. According to one embodiment of the present methodology, the first or second digital processor applies a one-sided gain reduction in step 345 to the hearing aid subjected to lowest incoming sound level. This action may involve comparing the level of the first microphone signal 60L to the level of the second microphone signal (not shown), either broad-band for example frequencies between 100 Hz and 10 kHz, or to any particular frequency band of those discussed above to identify which of the first and second hearing aids that is subjected to the lowest level of the incoming sound in that frequency band or broad-banded. This comparison may be carried out by the first digital processor by a simple inspection of a sign of the ILD for that frequency band computed in step 380. If for example the left ear hearing aid has the lowest level of incoming sound, the first digital processor adjusts, typically by reducing, in step 345 exclusively the gain of the left ear hearing aid so as to preserve or re-establish the interaural level difference as determined by step 380 between first and second output acoustic output signals. This may be convenient because the hearing aid subjected to the lowest incoming sound level typically exhibits a higher gain than the opposite hearing aid due to the level dependent gain imparted to the first and second microphone signals 60L, 60R by the respective dynamic range compressors. Reducing the first gain of the left ear hearing aid to re-establish the appropriate interaural level difference in that situation reduces possible feedback stability problems. The one-sided gain reduction serves at the same time to maintain the initially determined second gain value of the dynamic range compressor of the second hearing thereby avoiding to introduce new gain induced feedback problems. The skilled person will understand that the hearing aid subjected to the lowest incoming sound level may change dynamically depending on positions and movements of environmental sound sources, like a speaker, around the hearing aid user and depending on the hearing aid user's orientation in space. Therefore, according to certain embodiments of the present methodology of performing bilateral dynamic range compression and corresponding binaural hearing aid system, the one-sided gain reduction in step 345 may over time be alternatingly applied to the first gain of the first dynamic range compressor of the first hearing aid and the second gain of the second dynamic range compressor of the second hearing aid—for example as determined by the sign of the ILD. This embodiment preferably comprises a bidirectional wireless communication link 12 (shown in FIGS. 1 and 2) such that the first hearing aid 10L transmits the first contralateral audio data 61L to the second hearing aid 10R via the bidirectional wireless communication link. The second digital processor 24R is preferably configured to make an independent or parallel estimation of the interaural level difference by estimating a second interaural level difference of the incoming sound based on respective levels of the second microphone signal 60R and the first contralateral audio data 61L. The second digital processor 24R is configured to determine the second gain of the second microphone signal 60R and adjust the second gain based on the determined second interaural level difference. The second digital processor 24R is further configured to apply the adjusted second gain to the second microphone signal to preserve, between first and second output signals, the second interaural level difference. Hence, in the latter embodiment, the first and second hearing aids are configured to operate in a symmetric manner as regards estimation of the first and second interaural level differences of the incoming sound and the initial determination of the first and second gains and the respective gain adjustments.

The skilled person will appreciate that alternative embodiments of the present methodology and binaural hearing aid system may prevent the undesired reduction of ILD in other ways for example by utilizing two-sided gain adjustment. According to one such embodiment the first or second digital processor 24L, 24R reduces the gain in step 345 of the hearing aid subjected to lowest incoming sound level. The digital processor of the opposite hearing aid increases the gain of the hearing aid subjected to the highest sound level in step 345 so as that the combined gain adjustments preserve the interaural level difference, as determined by step 380, between first and second output signals. This action may involve comparing the level of the first microphone signal 60L to the level of the second microphone signal 60R, either broad-band, or in any particular frequency band or bands, of those discussed above to identify which of the first and second hearing aids that is subjected to the lowest level of the incoming sound in that frequency band or broad-banded.

Certain embodiments of the present methodology and binaural hearing aid system may comprise a first voice activity detector 370 as illustrated on FIG. 3. The respective signal levels of the first plurality of frequency bands outputted at step 320 may be applied to an input of the first voice activity detector 370 (VAD). The first voice activity detector 370 uses this plurality of signal levels for detecting speech segments and non-speech segments in the first microphone signal 60L and a corresponding voice activity detector of the second hearing aid analyses the second microphone signal in a corresponding manner. The adjustment of the first gain of the first microphone signal 60L by step 345 is only carried out on the detected speech while the gain adjustment is discarded for non-speech segments. In this manner, the above-discussed undesired reduction of ILD by the dynamic range compression of the first microphone signal 60L is selectively compensated for speech signals while various type of environmental noise signals are rendered ILD uncompensated. This has the advantage that the first and/or second ILD may be predicted more accurately for the speech segments of the first and/or second microphone signals 60L, 60R and may contribute to localization of the speech segments of the first and/or second microphone signals 60L, 60R. Such localization of speech segments of the first and/or second microphone signals 60L, 60R has been proven to further increase speech intelligibility The VAD 370 may be of entirely conventional construction or design and therefore common general knowledge. One exemplary embodiment of the VAD 370 utilizes the following signal processing strategy: for each time-frequency bin or frequency band, if the current signal power P(f,t) is greater by a threshold than the estimated Ambient noise level Amb(f,t), then set a Voice-Activity Indicator (VAI) to 1, otherwise VAI (f,t)=0. These actions require a separation between speech and noise signals (f,t). This is achieved by two low-pass filters with different time constants. What actually is separated is the signal plus noise stream from the noise stream alone. Since envelopes of speech signals are varying quicker it allows to filter the desired speech segments from background noise.

As briefly discussed above, the inherent proximity between the first sound inlet 18L and the sound outlet 33L in the housing of the left ear plug 30L (shown in FIG. 1) results in a relatively limited acoustic attenuation between these sound port and may limit a maximum stable gain of the left ear hearing aid 10L to an undesirable low value. The maximum stable gain may be significantly increased, often by 15-20 dB, by including an adaptive feedback cancellation algorithm in the first digital processor 24L. The first digital processor 24L is configured or programmed to determine a transfer function of a first feedback path from the first acoustic output signal 355 to the first in-ear microphone 16L. The first digital processor 24L is further configured to compensate the first feedback path by a fixed or adaptive feedback cancellation filter to increase the maximum stable gain of the first hearing aid.

An alternative method, or even complementary method, of increasing the maximum stable gain of the left ear hearing aid 10L involves exploiting an additional microphone signal picked-up or received at a different physical location of the housing structure of the hearing aid 10L than the in-ear microphone 16L. This additional microphone may be one, or both, of the first pair of omnidirectional microphones 17L that are arranged in the left ear BTE housing 210L as schematically illustrated on FIG. 2. The additional microphone signal of the additional microphone, "BTE microphone signal", and the first in-ear microphone signal may be mixed or combined in a frequency dependent ratio to generate a first hybrid microphone signal which is subjected to the previously discussed processing steps of FIG. 3. Because this additional microphone is positioned markedly further away from the first receiver 32L than the first in-ear microphone, feedback signals emitted by the first receiver 32L more attenuated than to the first in-ear microphone 16L. The ratio between the BTE microphone signal and the first in-ear microphone signal may be controlled by the first digital processor 24L such that the hybrid microphone signal constantly has substantially the same level as the first in-ear microphone signal. The contribution of the first in-ear microphone signal to the hybrid microphone signal may set to a relatively small amount, e.g. 0.1-0.33, in specific frequency bands or frequency ranges where feedback problems exist, e.g. because the maximum stable gain exceeds the actual gain, and relatively large, e.g. 0.8-1.0, in frequency bands or ranges without feedback problems. This frequency dependent mixing of the BTE microphone signal and the first in-ear microphone signal ensures the BTE microphone signal has a dominating contribution, e.g. larger than 0.5, to the hybrid microphone signal in feedback sensitive frequency regions so as to effectively reduce the gain of the first in-ear microphone signal. This reduction of gain of the first in-ear microphone signal serves to reduce loop gain of the feedback path between the first receiver 32L and the first in-ear microphone 16L and thereby increase the maximum stable gain of the left ear hearing aid 10L.

Figure 4:
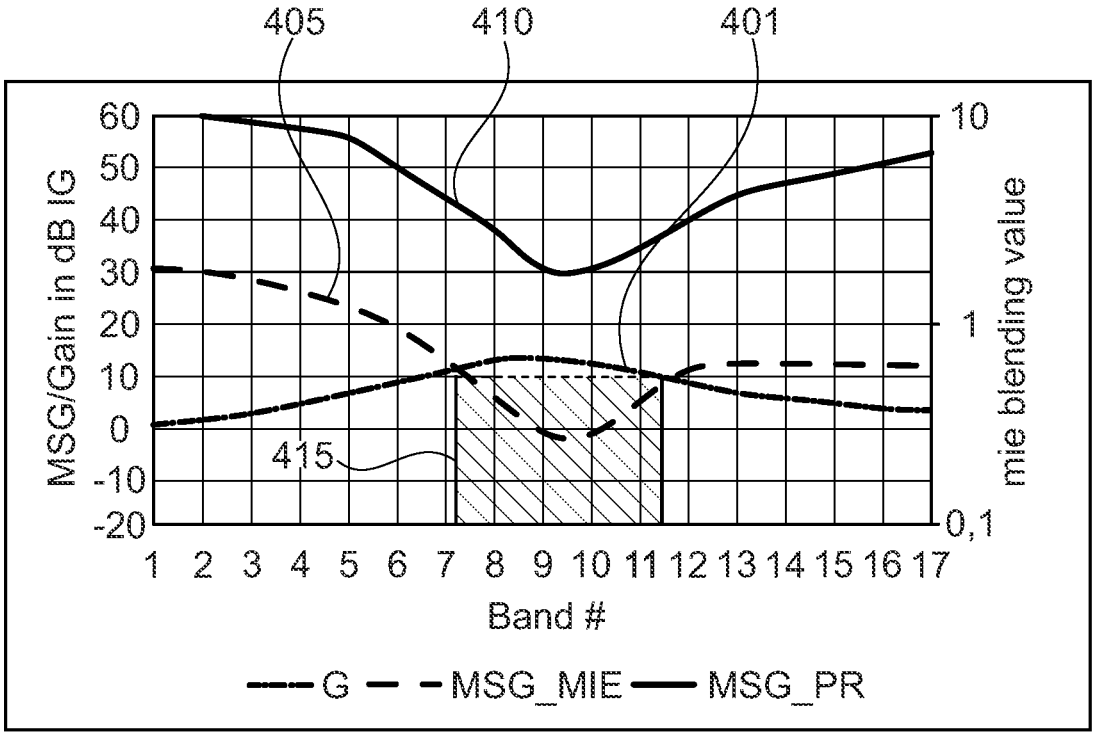
FIG. 4 is a schematic illustration of maximum stable gain computation across a plurality of frequency bands of a first dynamic range compressor of a left ear hearing aid of the bilateral hearing aid system.

FIG. 4 shows a schematic illustration of a result of a maximum stable gain computation for the left ear hearing aid 10L of the bilateral hearing aid system across a plurality of frequency bands 1 to 17. Gain curve 401 illustrates on the left vertical scale acoustic insertion gain of the left ear hearing aid 10L. Gain curve 405 illustrates estimated maximum stable gain of the left ear hearing aid 10L when using exclusively the first in-ear microphone 16L for sound pick-up/sound receipt and amplification. Gain curve 410 illustrates estimated maximum stable gain of the left ear hearing aid 10L when using exclusively the first pair of omnidirectional microphones 17L for sound pick-up/sound receipt and amplification.

As expected, the latter maximum stable gain is significantly higher than the maximum stable gain of the first in-ear microphone 16L inter alia due to a larger physical separation between the first pair of omnidirectional microphones 17L and the first receiver 32L. The first digital processor 24L may apply attenuation to the first microphone signal in the frequency range indicated by the black square 415, because the maximum stable gain is lower than the acoustic insertion gain in that frequency range indicating that acoustical feedback oscillation is likely. The attenuation of the first microphone signal may be carried out by mixing or blending in the microphone signal generated by the first pair of omnidirectional microphones 17L such that the latter is dominating in the first hybrid microphone signal. The mixing is preferably carried out such that a level of the first hybrid microphone signal largely corresponds to the level of the first microphone signal.

Although the above embodiments have mainly been described with reference to certain specific examples, various modifications thereof will be apparent to those skilled in art without departing from the spirit and scope of the invention as outlined in claims appended hereto. The specification and drawings are, accordingly to be regarded in an illustrative rather than restrictive sense. The claimed invention is intended to cover all alternatives, modifications, and equivalents.

LIST OF REFERENCES

10L first hearing aid
10R second hearing aid
12 wireless communication link
16L first in-ear microphone
16R second in-ear microphone
17L first additional microphone
17R second additional microphone
18L first sound inlet
18R second sound inlet
24L first digital processor
24R second digital processor
25L first hearing aid circuitry
25R second hearing aid circuitry
26L first bidirectional wired interface
26R second bidirectional wired interface
30L first ear plug
30R second ear plug
32L first receiver
32R second receiver
33L first sound outlet
33R second sound outlet
34L first wireless data communication interface
34R second wireless data communication interface
44L first antenna
44R second antenna
50 binaural hearing aid system
60L first microphone signal
60R first microphone signal
61L first contralateral audio data
61R second contralateral audio data
210L first BTE housing
210R second BTE housing
310 Analysis filter bank configured to split or divide the first microphone signal into a first plurality of frequency bands
320 determine first signal levels of the first plurality of frequency bands
330 smooth the first signal levels
340 determine a first initial gain value of the compressor or compressor algorithm
345 apply plurality of initial first gain values to the adjustment processing to determine a corresponding plurality of adjusted first gain values
350 apply the plurality of adjusted first gain values to the plurality of frequency bands
355 provide a corresponding acoustic output signal
360 smooth the first signal levels
370 Voice activity detector configured to detect speech segments and non-speech segments in the first microphone signal
380 determine a first plurality of interaural level differences (ILDs) between the first and second microphone signals per frequency band
390 subtract the smoothed signal level estimates of the second plurality of frequency bands from the correspondingly smoothed signal level estimates of the first plurality of frequency bands.

The invention claimed is:

1. A method performed by a binaural hearing aid system having a first hearing aid and a second hearing aid, the method comprising:

generating a first microphone signal by a first microphone of the first hearing aid based on sound pressure inside a first ear canal of a first ear of a user;

generating a second microphone signal by a second microphone of the second hearing aid based on sound pressure inside a second ear canal of a second ear of the user;

transmitting contralateral audio data representative of the second microphone signal to the first hearing aid via a wireless communication link;

estimating, by a first digital processor at the first hearing aid, a first interaural level difference based on the first microphone signal and the second contralateral audio data;

determining a first gain for the first microphone signal based on a level of the first microphone signal in accordance with a first level-versus-gain characteristic;

determining a second gain for the second microphone signal based on a level of the second microphone signal in accordance with a second level-versus-gain characteristic;

adjusting the first gain based on the first interaural level difference; and applying the adjusted first gain to the first microphone signal to generate a first output signal.

2. The method according to claim 1, further comprising:

transmitting another contralateral audio data representative of the first microphone signal to the second hearing aid via the wireless communication link;

estimating, by a second digital processor, a second interaural level difference based on the second microphone signal and the other contralateral audio data;

adjusting the second gain based on the second interaural level difference; and applying the adjusted second gain to the second microphone signal.

3. The method according to claim 2, wherein the adjusted second gain is applied to the second microphone signal to preserve the second interaural level difference.

4. The method according to claim 2, further comprising:

comparing, by the first digital processor or by the second digital processor, the first microphone signal and the second microphone signal to determine which of the first and second hearing aids is subjected to a lower level of incoming sound; and reducing a gain of one of the first hearing aid and the second hearing aid that is subjected to the lower level of incoming sound, to preserve the first or second interaural level difference.

5. The method according to claim 4, further comprising:

increasing a gain of the other one of the first hearing aid and the second hearing aid that is subjected to a higher level of the incoming sound, to preserve the first or second interaural level difference.

6. The method according to claim 1, wherein the contralateral audio data representing the second microphone signal comprises a power level, an energy level, a native digital audio representation, or any combination of the foregoing, associated with the second microphone signal.

7. The method according to claim 1, wherein the contralateral audio data comprises a perceptually encoded signal selected from the group consisting of MP3, FLAC, AAC, Vorbis, MA4, Opus, and G722.

8. The method according to claim 1, further comprising:

splitting the first microphone signal into a first plurality of first sub-signals in different frequency bands; and splitting the second microphone signal into a second plurality of second sub-signals in different frequency bands;

wherein the act of estimating comprises estimating a first plurality of interaural level differences associated with the first plurality of first sub-signals and the second plurality of second sub-signals;

wherein the act of determining the first gain comprises determining a first plurality of gain values for the first plurality of first sub-signals, respectively;

wherein the act of determining the second gain comprises determining a second plurality of gain values for the second plurality of second sub-signals, respectively;

wherein the act of adjusting the first gain comprises adjusting the first plurality of gain values based on respective ones of the first plurality of interaural level differences; and wherein the act of applying the adjusted first gain comprises applying the first plurality of adjusted gain values to respective ones of the first plurality of first sub-signals.

9. The method according to claim 1, further comprising:

generating a first additional microphone signal by a first additional microphone of the first hearing aid arranged at, or behind, the first ear;

generating a first additional microphone signal by a second additional microphone of the second hearing aid arranged at, or behind, the second ear;

mixing the first additional microphone signal and the first microphone signal to obtain a first hybrid microphone signal; and mixing the second additional microphone signal and the second microphone signal to obtain a second hybrid microphone signal.

10. The method according to claim 1, further comprising:

determining a transfer function of a first feedback path from the first output signal to the first microphone signal by the first digital processor; and compensating the first feedback path by a fixed or adaptive feedback cancellation filter to increase a maximum stable gain of the first hearing aid.

11. The method according to claim 1, further comprising:

generating a first additional microphone signal by an additional microphone of the first hearing aid arranged at, or behind, the first ear; and mixing the first additional microphone signal and the first microphone signal to obtain a hybrid microphone signal, wherein the mixing is performed such that the first additional microphone signal dominates in the hybrid microphone signal in a frequency range where the first gain exceeds a maximum stable gain of the first hearing aid.

12. The method according to claim 1, wherein the first gain and/or the second gain is adjusted for interaural level differences exceeding a threshold value.

13. The method according to claim 12, wherein the threshold value is 1 dB or higher.

14. The method according to claim 12, wherein the first gain and/or the second gain is not adjusted for interaural level differences below the threshold value; or wherein an adjustment of the first gain and/or an adjustment of the second gain for interaural level differences below the threshold value is discarded.

15. The method according to claim 1, further comprising detecting speech segment(s) and non-speech segment(s) in the first microphone signal and the second microphone signal;

wherein the first gain and/or the second gain is adjusted for the speech segment(s).

16. The method according to claim 15, wherein the first gain and/or the second gain is not adjusted for the non-speech segment(s); or wherein an adjustment of the first gain and/or an adjustment of the second gain for the non-speech segment(s) is discarded.

17. The method according to claim 1, further comprising applying the second gain to the second microphone signal to generate a second output signal.

18. The method according to claim 1, wherein the first interaural level difference is between the first and second microphone signals, and wherein the first gain is adjusted based on the first interaural level difference to preserve the first interaural level difference between first and second microphone signals.

19. A binaural hearing aid system comprising:

a first hearing aid configured for placement at, or in, a first ear of a user, the first hearing aid comprising a first microphone arrangement and a first digital processor, wherein the first microphone arrangement comprises a first in-ear microphone configured to pick-up sound pressure inside a first ear canal; and a second hearing aid configured for placement at, or in, a second ear of the user, the second hearing aid comprising a second microphone arrangement and a second digital processor, wherein the second microphone arrangement comprises a second in-ear microphone arranged to pick-up sound pressure in a second ear canal;

wherein the first hearing aid and the second hearing aid are connectable through a wireless communication link;

wherein the first digital processor is configured to:

receive a first microphone signal generated by the first in-ear microphone, receive contralateral audio data representative of a second microphone signal transmitted from the second hearing aid to the first hearing aid via the wireless communication link, estimate a first interaural level difference based on the first microphone signal and the contralateral audio data, determine a first gain for the first microphone signal based on a level of the first microphone signal in accordance with a first level-versus-gain characteristic, adjust the first gain, and apply the adjusted first gain to the first microphone signal to generate a first output signal.

20. The binaural hearing aid system according to claim 19, the first output signal is configured to preserve the first interaural level difference.

21. The binaural hearing aid system according to claim 19, wherein the second digital processor is configured to:

determine a second gain for the second microphone signal based on a level of the second microphone signal in accordance with a second level-versus-gain characteristic, and apply the second gain to the second microphone signal to generate a second output signal.

22. The binaural hearing aid system according to claim 19, wherein the first hearing aid is configured to transmit another contralateral audio data representative of the first microphone signal to the second hearing aid via the wireless communication link; and wherein the second digital processor is further configured to:

estimate a second interaural level difference based on the second microphone signal and the other contralateral audio data, adjust the second gain based on the second interaural level difference, and apply the adjusted second gain to the second microphone signal.

23. The binaural hearing aid system according to claim 19, wherein the first hearing aid comprises a first BTE housing configured for placement behind the first ear, and a first ear plug configured for placement at least partly inside the first ear canal, wherein the first ear plug comprises the first in-ear microphone; and wherein the second hearing aid comprises a second BTE housing configured for placement behind the second ear, and a second ear plug configured for placement at least partly inside the second ear canal, wherein the second ear plug comprises the second in-ear microphone.

24. The binaural hearing aid system according to claim 23, wherein the first ear plug comprises an outwardly oriented surface comprising a first sound inlet for the first in-ear microphone, and a first inwardly oriented surface or portion comprising a first sound outlet for a first miniature speaker or receiver configured to provide the first output signal; and wherein the second ear plug comprises an outwardly oriented surface comprising a second sound inlet for the second in-ear microphone, and a second inwardly oriented surface or portion comprising a second sound outlet for a second miniature speaker or receiver configured to provide a second output signal.

25. The binaural hearing aid system according to claim 23, wherein the first hearing aid comprises a first additional microphone in the first BTE housing configured to generate a first additional microphone signal; and wherein the second hearing aid comprises a second additional microphone in the second BTE housing configured to generate a second additional microphone signal.

* * * * *